United States Patent [19]

Kitchin et al.

[11] Patent Number: 4,746,593

[45] Date of Patent: May 24, 1988

[54] SILVER HALIDE RADIATION-SENSITIVE PHOTOGRAPHIC MATERIALS

[75] Inventors: Jonathan P. Kitchin, Hertford; Kevin P. Hall, Harlow, both of England

[73] Assignee: Minnesota Mining and Manufacturing Company, St. Paul, Minn.

[21] Appl. No.: 881,081

[22] Filed: Jul. 2, 1986

[30] Foreign Application Priority Data

Jul. 4, 1985 [GB] United Kingdom ..... 8516934

[51] Int. Cl.[4] ..... G03C 1/02; G03C 1/06; G03C 1/42

[52] U.S. Cl. ..... 430/264; 430/567; 430/568; 430/571

[58] Field of Search ..... 430/264, 567, 568, 571

[56] References Cited

U.S. PATENT DOCUMENTS

| | | | |
|---|---|---|---|
| 2,410,690 | 11/1946 | Smith et al. . | |
| 4,168,977 | 9/1979 | Takada et al. | 96/63 |
| 4,201,841 | 5/1980 | Groet et al. | 430/567 |
| 4,269,929 | 5/1981 | Nothnagle | 430/264 |
| 4,444,865 | 4/1984 | Silverman et al. | 430/217 |
| 4,547,458 | 10/1985 | Iijima et al. | 430/567 |
| 4,639,410 | 1/1987 | Mochizuki et al. | 430/567 |

FOREIGN PATENT DOCUMENTS

| | | |
|---|---|---|
| 57-58137 | 4/1982 | Japan . |
| 1342687 | 3/1974 | United Kingdom . |

*Primary Examiner*—Paul R. Michl
*Assistant Examiner*—Mark R. Buscher
*Attorney, Agent, or Firm*—Donald M. Sell; James A. Smith; Mark A. Litman

[57] ABSTRACT

A negative-acting photographic element comprising a support having coated thereon one or more layers of a radiation-sensitive silver halide emulsion, at least one of the layers containing a hydrazine compound in which the one or more radiation-sensitive silver halide layers contain a first silver halide emulsion having an average grain size of from 0.1 to 0.4 microns and a second silver halide emulsion of particles with an average grain volume of less than one half that of the particles of the first emulsion.

19 Claims, No Drawings

SILVER HALIDE RADIATION-SENSITIVE PHOTOGRAPHIC MATERIALS

FIELD OF THE INVENTION

This invention relates to photographic materials and in particular to silver halide radiation-sensitive photographic materials having a high contrast.

BACKGROUND OF THE INVENTION

Silver halide materials which are used to generate halftone dot images, also called screened images, for use in the photolithographic printing process are commonly referred to as "lith" films. An essential characteristic of lith film is that it has an extremely high contrast; generally greater than 10. There are two commercial processes which are used to achieve this high contrast effect. The first process, referred to herein as "conventional lith", utilises a silver halide emulsion of high chloride content which is processed in a developing solution containing hydroquinone, as the principle or sole developing agent, and a low quantity of sulphite ion. The second process, referred to herein as the "hydrazine-lith" process, involves the incorporation of a hydrazine or hydrazide derivative in a negative-acting, surface latent image silver halide emulsion and processing in a developer of high pH (generally greater than 11). The hydrazine derivative may alternatively be present in the developer solution but this is not preferred.

The hydrazine-lith process is disclosed in U.S. patent specification Nos. 2,419,975, 4,168,977 and 4,224,401. Modifications and improvements to the process are disclosed in U.S. patent specification Nos. 2,419,974, 2,410,690, 4,269,929, 4,166,742, 4,221,857, 4,237,214, 4,241,164, 4,311,871, 4,243,739 and 4,272,614. In all of the foregoing patents, where a preference is expressed as to the grain size distribution of the silver halide emulsion, it is stated that monodisperse or narrow grain size distribution emulsions are most suitable. A monodispersed emulsion is defined as one in which 90% of the silver halide grains have a grain size in the range of ±40% of the average grain size.

U.S. patent specification No. 4,444,865 describes a method by which the covering power of core shell type direct positive emulsions may be increased by combining two silver halide emulsions of different grain size. The method disclosed relates to direct positive emulsions of the internal latent image type which contain a hydrazine or other nucleating agent. This direct positive process is quite different in mechanism, method of manufacture and application from the negative-acting hydrazine-lith process.

Japanese Patent Application No. 57-58137 discloses a silver halide light-sensitive photographic material which contains a compound represented by the following general formula:

$$R^1—NHNH—COR^2 \quad (I)$$

in which:

$R^1$ is an aryl radical which may or may not be substituted, and $R^2$ represents a hydrogen atom, an aryl radical which may or may not be substituted, or an alkyl radical which may or may not be substituted, in an emulsion layer and/or some other hydrophilic colloid layer, forming a silver halide emulsion exhibiting a grain size distribution curve possessing at least one peak in the fraction with grain size below 0.4 micron and at least one peak in the fraction with grain size above 0.7 micron, but without a peak in the fraction exceeding grain size of 0.4 micron but not reaching grain size of 0.7 micron, the light sensitive photographic material possessing at least one silver halide emulsion layer on a support. It is stated that if the fine grain emulsion exceeds 0.4 micron there is a reduction in Dmax and if the coarse grain emulsion is below 0.7 micron the sensitivity is extremely low and is considered to be unsuitable for practical application.

It has now been found, contrary to the teaching of the prior art, that hydrazine-lith type silver halide emulsions may comprise a combination of two emulsions having a grain size below 0.4 microns and provide suitable sensitivity, contrast, and density for graphic arts, lith, line and scanner applications.

SUMMARY OF THE INVENTION

Therefore according to the present invention there is provided a negative-acting photographic element comprising a support having coated thereon one or more layers of a radiation-sensitive silver halide emulsion, at least one of the layers containing a hydrazine compound characterised in that the one or more radiation-sensitive silver halide layers contain a first silver halide emulsion having an average grain size of from 0.1 to 0.4 microns and a second silver halide emulsion of particles with an average grain volume of less than one half that of the particles of the first emulsion.

DETAILED DESCRIPTION OF THE INVENTION

The invention provides a considerable saving of silver compared to conventional coatings of the hydrazine-lith type by using a mixture of two silver halide emulsions whilst retaining the desirable sensitometric properties. The first emulsion is the primary light sensitive component of the coating and has an average grain size of 0.1 to 0.4 microns. The second emulsion is of much lower sensitivity and has an average grain volume less than half that of the first emulsion, preferably less than one quarter. The ratio of the first emulsion to the second emulsion by weight is preferably between 1:19 and 2:1. The two emulsions may be present in a single layer or in separate adjacent layers.

The elements of the invention may be developed with conventional developers used in the hydrazine-lith process. Suitable developers contain hydroquinone and may also include a 3-pyrazolidinone derivative or Metol (N-methyl-p-aminophenol hemisulphate). The developer solutions have a high pH, generally above 9.5, preferably above 11.5. The developer solutions also contain sulphite ion, generally at least 0.5 moles sulphite per liter.

The grain characteristics described above of the silver halide emulsions used in this invention can be readily ascertained by procedures well known to those skilled in the art. The grain size of a silver halide emulsion may be taken as the diameter of a circle which has an area equal to the average projected area of the silver halide crystals as viewed in a photomicrograph or electron micrograph of an emulsion sample. Similarly, the volume of the silver halide grains may be determined by examination of photomicrographs or electron micrographs including shadowed electron micrographs of an emulsion sample. The volume of particles having cubic, octrahedral and spherical morphology can readily be determined from the particle size and the volume of particles having tabular morphology can be ascertained by determining the grain size and then the thickness by shadow electron micrograph.

It will be appreciated that when the first and second emulsions have the same crystal morphology the grain size of the second emulsion will be less than that of the first emulsion. However, when the first and second emulsions have different crystal morphology the emulsions may have comparable grain sizes.

The combined first and second emulsions possess a distribution of grains such that a plot of total volume or weight of grains against grain size or grain diameter will exhibit at least two distinct peaks. One peak will be in the range of 0.1 to 0.4 microns and the second peak will correspond to the grains with an average grain volume less than one half of the grains representing the first peak.

The silver halide emulsions used in the present invention may be of the same or different halide composition. Silver bromide, iodobromide, iodochlorobromide, chlorobromide, iodochloride and chloride emulsions are, for example, suitable for use in this invention.

The silver halide layers may be sensitive to ultraviolet, visible and/or near infrared radiation, generally up to 1000 nm.

The silver halide emulsions can be prepared by various techniques that are well known in the field of silver halide light-sensitive photographic materials. For example, each of the above mentioned emulsions can be prepared using methods described by P. Glafkides in Chimie et Physique Photographique (published by Paul Montel, 1967), G. F. Duffin in Photographic Emulsion Chemistry (published by The Focal Press, 1966), and V. L. Zelikman et al, in Making and Coating Photographic Emulsion (published by The Focal Press, 1964). Thus, either the acidic method, the neutral method or the ammonia method may be used. Moreoever it is possible to use a single mixing method, simultaneous mixing method, or combination of these, for reaction of soluble silver salts and soluble halides.

A method by which particles are formed under silver ion excess, commonly referred to as the inverse mixing method, can also be used. In one form of simultaneous mixing method, constant pAg is maintained in the liquid phase for forming the silver halide, i.e. what is known as a controlled double jet method can be used.

High aspect ratio tabular grain silver halide emulsions, for example as disclosed in U.S. patent specification No. 4,439,520, may also be used.

The silver halide particles in the photographic emulsion may consist of regular crystals such as cubes and octahedra, or they may have an irregular crystal habit, e.g. globules or lamellae, or may comprise a mixture thereof. The silver halide particles may have different phases in the surface layer and in the interior, or they may consist of a homogenous phase.

In silver halide particle formation or the physical ripening process, dopants and additives such as cadmium salt, zinc salt, lead salt, thallium salt, iridium salt or its complex salt, rhodium salt or its complex salt, ruthenium salt or its complex salt, iron salt or iron complex salt, etc. may be used.

After formation of the precipitate or after physical ripening, soluble salts usually are removed from the emulsion, e.g. utilising gelation of the gelatin and washing with water, or a precipitation method (flocculation) employing inorganic salts consisting of multivalent anions, for example sodium sulphate, anionic surfactant, anionic polymer (e.g. polystyrene sulphonate) or a gelatin derivative (e.g. aliphatic acylated gelatin, aromatic acylated gelatin, aromatic carbamoylated gelatin, etc.). It is also possible to omit the process of removal of soluble salts.

The silver halide emulsions used can be so-called "primitive" emulsion, i.e. without performing chemical sensitisation. Chemical sensitisation is preferred for the first emulsion. The second emulsion is preferably chemically unsensitised.

For chemical sensitisation it is possible to use the sulphur sensitisation method employing active gelatin and a sulphur-containing compound that reacts with silver ions, the reduction sensitisation method employing reducing properties, and precious metal sensitisation employing compounds of gold and other precious metals, and these methods can be used alone or combined.

The techniques are described in the above mentioned reports of Glafkides or Zelikman et al, or in H. Freiser: Die Grundlagen der Photographischen Prozesse mit Silberhalogeniden [Principles of photographic processes with silver halides] (Akademische Verlagsgesellschaft, 1968). As sulphur sensitiser it is possible to use thiosulphate, thioureas, thiazoles, rhodanines and other compounds as disclosed in U.S. patent specification Nos. 1,574,944, 2,410,689, 2,287,947, 2,728,665 and 3,656,955. As reducing sensitiser it is possible to use stannous salts, amines, formamidine-sulphines, silanes, etc. as disclosed in U.S. patent specification Nos. 2,487,850, 2,518,698, 2,983,609, 2,983,610, 2,694,637, 3,930,867 and 4,054,458. For precious metal sensitisation, in addition to gold complex salts, it is possible to use complex salts of platinum, iridium, palladium and other metals of Group VIII of the Periodic Table as disclosed in U.S. patent specification Nos. 2,399,083 and 2,448,060 and in British patent specification No. 618 061.

It seems probable that development of the first silver halide emulsion in the presence of the hydrazine derivative causes fogging and subsequent development of the second emulsion in the vicinity. Since the covering power of developed silver is an inverse function of the grain size of the original silver halide for a given morphology the development of the smaller grain size emulsion allows an increase in the density of the silver image or, alternatively, a reduction in silver coating weight for the same image density. It is surprising that development of the first emulsion should cause co-development of the second emulsion since this does not happen under normal development conditions, neither does it occur under "infectious development" conditions of the conventional lith process, see, for example, M. Austin, J. Phot. Sci., 1974, 22, 293. This is a very advantageous effect, which allows as much as a 50% saving in silver.

Although this invention is primarily applicable to very high contrast graphic art films, it is also of value for lower contrast photographic materials such as X-ray recording films or camera films. The contrast may, to some extent, be modified by adjustment of developer pH. Both the silver halide emulsions for use in this invention must be substantially of the surface latent image type. In the present invention "substantially surface latent image type" is defined as the condition where, on developing, after exposure for about 1 to 0.01 second according to "Surface Development A" and according to "Internal Development B" the sensitivity obtained by Surface Development A is greater than that obtained by Internal Development B. Surface Development A comprises developing for 10 minutes at 20° C. in the following composition:

| | |
|---|---|
| N—methyl-p-aminophenol hemisulphate | 2.5 g |
| ascorbic acid | 10 g |
| sodium metaborate tetrahydrate | 35 g |
| potassium bromide | 1 g |
| water to make 1 liter | |

Internal Development B comprises the following steps:

processing for 10 minutes at 20° C. in a bleaching solution containing 3 g/1 of potassium ferricyanide and 0.0125 g/1 of phenosafranine, washing for 10 minutes, developing for 10 minutes at 20° C. in a formulation containing:

| | |
|---|---|
| N—methyl-p-aminophenol hemisulphate | 2.5 g |
| ascorbic acid | 10 g |
| sodium metaborate tetrahydrate | 35 g |
| potassium bromide | 1 g |
| sodium thiosulphate | 3 g |
| water to make 1 liter | |

The emulsions of this invention may be coated as a mixture in the same layer or they may be coated separately as contiguous layers. The hydrazine derivative is incorporated in a conventional manner into one of the coated layers of the photographic element, preferably into the layer which contains the first silver halide component.

Hydrazine derivatives suitable for use in this invention may be selected from those known in the art. In general the hydrazine will be selected from compounds of the formula:

$$R^3—NHNH—G—R^4 \quad (II)$$

in which:

$R^3$ represents an aromatic or aliphatic group, $R^4$ represents a hydrogen atom or an alkyl, aryl, alkoxy or aryloxy group, any of which groups may be substituted, and G represents a carbonyl, sulphonyl, sulphoxy, phosphoryl or an N-substituted or un-substituted amino group.

$R^3$ is preferably an aliphatic group containing 1 to 30 carbon atoms, an unsaturated heterocyclic group or a monocyclic or dicyclic aryl group, each of which groups may be substituted. More preferably $R^3$ represents an optionally substituted phenyl group.

Preferably $R^4$ represents a monocyclic or dicyclic aryl group, an alkyl group containing 1 to 4 carbon atoms, an alkoxy group containing 1 to 8 carbon atoms or a monocyclic aryloxy group, each of which groups may be substituted. Specific examples of $R^4$ groups include methyl, ethyl, methoxy, ethoxy, butoxy, phenyl, 4-methylphenyl, phenoxy, cyanobenzyl and methylthiobenzyl.

Preferably G is carbonyl.

Particularly preferred hydrazine compounds are those of the general formula:

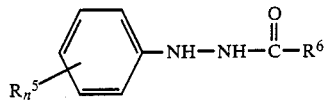

(III)

in which:

n is 0 or an integer of 1 to 5, each $R^5$ may be the same or different and is selected from substituents such that the total Hammet sigma value of the R substituents is less than 0.3, and $R^6$ represents a hydrogen atom, an optionally substituted phenyl group or an optionally substituted alkyl group containing 1 to 10 carbon atoms.

The $R^5$ groups when present are selected such that the total Hammet sigma value-derived electron withdrawing characteristic of the aromatic nucleus is less than +0.3. The Hammet sigma value is a quantitative method of specifying the electron donating or withdrawing properties of a substituent in a given position on a phenyl ring. The total Hammet sigma value for a combination of substituents may be taken as the algebraic sum of the sigma values of the individual substituents which are available in many tables of physical chemical constants.

Electron donating substituents are assigned negative Hammet sigma values and electron withdrawing substituents are assigned positive values. Preferred phenyl group substituents are those which are not electron withdrawing. Suitable substituents are, for example, straight or branched chain alkyl groups, alkoxy groups, acylamino groups and halogen atoms.

The substitution pattern on the phenyl group may also be designed to restrict the mobility of the molecule in the coated layer such as by incorporation of a ballasting group containing eight or more carbon atoms as disclosed in U.S. patent specification No. 4,269,929 or by the use of groups which will adsorb strongly to silver halide crystals as disclosed in that Patent.

Examples of preferred hydrazine compounds include:

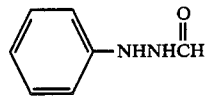

(1)

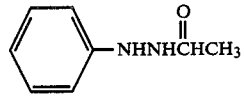

(2)

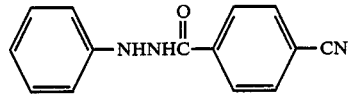

(3)

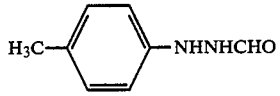

(4)

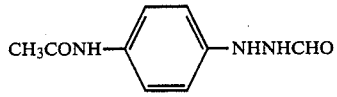

(5)

-continued (6)

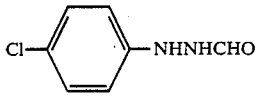

(7)

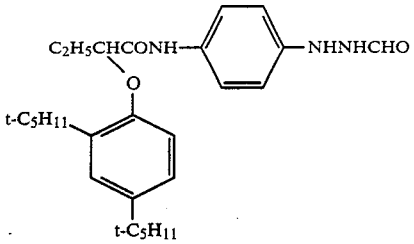

(8)

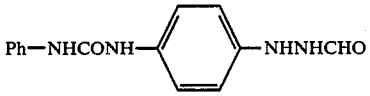

(9)

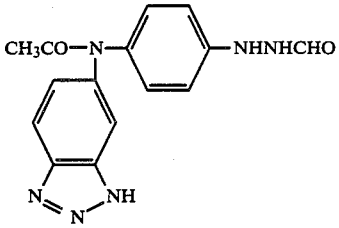

In addition to two populations of silver halide crystals and a hydrazine derivative, the photographic elements of this invention may contain any of the beneficial photographic additives which are known in the art such as: visible or near infrared sensitising dyes, stabilisers, antifoggants, hardeners, development accelerators, hydrophilic or hydrophobic polymers and matting agents.

Photographic additives which are particularly suited to hydrazine-lith photographic emulsions have been described in U.S. patent specification No. 4,168,977, Canadian patent specification No. 1,146,001 and Research Disclosure Item 23510 (1983) and references therein. Additives such as these may be included in either the photographic element of the present invention or in the developing solution. Contrast promoting agents such as amines disclosed in U.S. patent specification No. 4,269,929 may also be used.

The hydrazine derivative may be added to the silver halide emulsion mixture either as a solution in a water miscible solvent or as a dispersion in a water immiscible solvent which may also contain a non-volatile oil. The quantity of hydrazine which is coated with the silver halide depends on the type of aromatic substitution; generally 0.1 to 5 g of hydrazine per mole of silver is suitable, more usually 0.5 to 3 g of hydrazine per mole of silver.

The emulsions may be coated on conventional photographic supports e.g. biaxially oriented polyester e.g. polyethylanterephthalate. For lith process the bases are normally transparent.

The invention will now be illustrated by the following Examples.

EXAMPLE 1

Emulsion A

A silver halide emulsion comprising 15% AgCl and 85% AgBr, was prepared by the conventional double jet technique. The emulsion was of cubic morphology and narrow grain size distribution with an average crystal diameter of 0.23 micron. The emulsion was coagulated and washed in the conventional manner and reconstituted to give a final gelatin to silver ratio of 100 g gelatin/mole of Ag. The emulsion was not chemically sensitised.

Emulsion B

A second emulsion having the same halide composition and cubic morphology as Emulsion A was similarly prepared. In this case utilising the known methods of lowering the temperature and increasing the addition rate the final grain size was adjusted to 0.14 micron. The emulsion was coagulated and washed in the conventional manner and reconstituted to give a final gelatin to silver ratio of 100 g gelatin/mole of Ag. The emulsion was not chemically sensitised.

The ratio of the average grain volume of Emulsion A to Emulsion B was 4.4:1.

The following elements were prepared using Emulsions A and B.

Element 1

A coating composition was prepared by mixing Emulsion A with:

Wetting agent 0.4 g/mole Ag of 2-hydroxy-4,6-dichloro-1,3,5-triazine (hardener)

0.2 g/mole Ag of anhydro-5,5'-dichloro-9-ethyl-3,3'-bis(3-sulphopropyl)oxacarbocyanine hydroxide sodium salt (green sensitising dye)

3 g/mole Ag of 1-phenyl-2-formylhydrazine (hydrazine derivative).

The composition was coated onto polyester base at 1000 mg/m$^2$ of silver.

Element 2

A coating composition was prepared as described in Element 1 except that Emulsion B was used in place of Emulsion A and the sensitising dye was omitted.

Element 3

A two-layer coating was made consisting of a topcoat identical with the composition used in Element 1 above an underlayer identical with the composition used in Element 2.

Elements 1, 2 and 3 were individually exposed in a sensitometer to light from a 500 Watt tungsten filament lamp which was attenuated by a 0 to 4 continuous neutral density wedge in contact with the coating. The coatings were developed for 60 seconds at 28° C. in a developer of the following composition:

| | |
|---|---|
| sodium sulphite | 75 g |
| potassium hydroxide | 30 g |
| hydroquinone | 30 g |
| 1-phenyl-4-methyl-3-pyrazolidinone | 0.4 g |
| sodium bromide | 3.0 g |
| ethylene diamine tetraacetic acid (disodium salt) | 1.0 g |
| 5-methylbenzotriazole | 0.8 g |
| 3-diethylamino-1,2-propanediol | 20.0 g |

-continued

| |
|---|
| pH adjusted to 12.0 |
| water to 1 liter |

After development the samples were fixed, washed and dried. The sensitivity and density values thus obtained are shown in Table 1.

TABLE 1

| Element | Relative log sensitivity at density of 0.1 above fog | Maximum density | Minimum density |
|---|---|---|---|
| 1 (comparison) | 2.0 | 0.8 | 0.04 |
| 2 (comparison) | 0.6 | 2.4 | 0.04 |
| 3 (invention) | 2.1 | 3.0 | 0.04 |

It is clear from the data in Table 1 that development of the high sensitivity silver halide emulsion in the top layer has caused co-development of the low sensitivity, high covering power, emulsion coated below it thereby increasing the developed density. Element 3 illustrating the invention contained equal quantities by weight of the large and small grain sized emulsion.

EXAMPLE 2

Emulsion C

A silver halide emulsion was prepared having the same halide composition and cubic morphology as Emulsion A but with the precipitation conditions adjusted to give an average grain size of 0.10 microns. The emulsion was coagulated and washed in the conventional manner and reconstituted to give a final gelatin to silver ratio of 100 g gelatin/mole of Ag. The emulsion was not chemically sensitised.

Elements 4 to 6

Three coating compositions were prepared by mixing Emulsions A to C together in the following weight ratios: 50:50, 25:75 and 10:90. The ratio of the average grain volume of Emulsion A to Emulsion C was 12:1. The three coating compositions were admixed with the coating additives used with Element 1. Elements 4 to 6 were prepared by coating polyester base with each of the coating compositions to provide a silver coating weight of 1600 mg/m$^2$. The elements were exposed and processed as described in Example 1 and the sensitivity and density values of the elements are shown in Table 2.

TABLE 2

| Element | Mole ratio Emulsion A:C | Relative log sensitivity at density of 0.1 above fog | Maximum density | Minimum density |
|---|---|---|---|---|
| 4 | 50:50 | 2.1 | 2.3 | 0.04 |
| 5 | 25:75 | 2.0 | 3.1 | 0.04 |
| 6 | 10:90 | 2.0 | 3.4 | 0.04 |

It will be seen from the data in Table 2 that improvements in image density can be achieved by increasing the ratio of small:large grain size emulsion without any significant reduction in sensitivity or increase in total silver coating weight.

EXAMPLE 3

Emulsion D

A silver halide emulsion having a halide composition of AgBr:AgCl:AgI, 70:28:2 and an average grain size of 0.25 micron was prepared by the double jet method. The emulsion was washed and reconstituted and sulphur-sensitised by heating to 60° C. for 60 minutes with 6 mg sodium thiosulphate/mole of Ag.

A coating composition was prepared consisting of a mixture of 80% by weight of Emulsion C and 20% by weight of Emulsion D. The combined emulsions were mixed with the coating additives used in Element 1 except that the hydrazine used was 1 g/mole Ag of 1-formyl-2,4-(2-(2,4-di-t-pentyl phenoxy)butyramido)-phenylhydrazine. The composition was coated onto polyester base at a total silver coverage of 2000 mg/m$^2$ (Element 7).

A further coating composition was prepared using 100% of Emulsion D admixed with the coating additives for Element 7. The composition was coated at a silver coating weight of 4000 mg/m$^2$ (Element 8).

Emulsion C and Emulsion D were of cubic morphology, therefore the average grain volume of Emulsion C was one-twentieth of the average grain volume of Emulsion D.

Elements 7 and 8 were exposed and processed as described in Example 1; the sensitometric data thus obtained is shown in Table 3.

TABLE 3

| Element | Relative log sensitivity at density of 0.1 above fog | Maximum density | Minimum density | Contrast |
|---|---|---|---|---|
| 7 (invention) | 2.7 | 4.3 | 0.04 | 13 |
| 8 (comparison) | 2.8 | 4.5 | 0.04 | 15 |

The data in Table 3 illustrates that by the use of the present invention the silver coverage of a hydrazine-lith type material may be reduced by about one-half from 4000 mg/m$^2$ without significant loss in sensitivity or maximum density.

We claim:

1. A negative-acting photographic element comprising a support having coated thereon one or more layers of a radiation-sensitive silver halide emulsion, at least one of the layers containing a hydrazine compound characterized in that the one or more radiation-sensitive silver halide layers contain a first silver halide emulsion having an average grain size of from 0.to 0.4 microns and a second silver halide emulsion of particles with an average grain volume of less than one half that of the particles of the first emulsion, wherein one or more silver halide layers have a distribution of grains therein such that for the combined emulsions a plot of total volume of grain against grain size exhibits at least two distinct peaks, one peak lying in the range 0.1 to 0.4 microns.

2. An element as claimed in claim 1, characterised in that the particles of the second silver halide emulsion have an average grain volume of less than one quarter that of the particles of the first silver halide emulsion.

3. An element as claimed in claim 1, characterised in that the weight ratio of the first silver halide emulsion to the second silver halide emulsion is in the range 1:19 to 2:1.

4. An element as claimed in claim 1, characterised in that the first and second silver halide emulsions are present in a single layer.

5. An element as claimed in claim 1, characterised in that the first and second silver halide emulsions are present in adjacent layers.

6. An element as claimed in claim 1, characterised in that the first and second silver halide emulsions have the same crystal morphology.

7. An element as claimed in claim 1, characterised in that the first silver halide emulsion is spectrally sensitised.

8. An element as claimed in claim 1 characterised in that the hydrazine is a compound of the formula:

$$R^3—NHNH—G—R^4 \quad (II)$$

in which:

$R^3$ represents an aromatic or aliphatic group, $R^4$ represents a hydrogen atom or an alkyl, aryl, alkoxy or aryloxy group, any of which groups may be substituted, and G represents a carbonyl, sulphonyl, sulphoxy, phosphoryl or an N-substituted or un-substituted amino group.

9. An element as claimed in claim 8 characterised in that $R^3$ is an aliphatic group containing 1 to 30 carbon atoms, an unsaturated heterocyclic group or a monocyclic or dicyclic aryl group, each of which groups may be substituted, $R^4$ represents a monocyclic or dicyclic aryl group, an alkyl group containing 1 to 4 carbon atoms, an alkoxy group containing 1 to 8 carbon atoms or a monocyclic aryloxy group, each of which groups may be substituted and G is carbonyl.

10. An element as claimed in claim 1, characterised in that the hydrazine compound has the general formula:

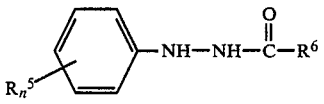

(III)

in which:

n is 0 or an integer of 1 to 5, each $R^5$ may be the same or different and is selected from substituents such that the total Hammet sigma value of the R substituents is less than 0.3, and $R^6$ represents a hydrogen atom, an optionally substituted phenyl group or an optionally substituted alkyl group containing 1 to 10 carbon atoms.

11. A photographic process which comprises imagewise exposing a photographic element as claimed in claim 1 followed by developing the element in a developer solution having a pH greater than 9.5.

12. An element as claimed in claim 2, characterised in that the weight ratio of the first silver halide emulsion to the second silver halide emulsion is in the range 1:19 to 2:1.

13. An element as claimed in claim 2, characterised in that the one or more silver halide layers have a distribution of grains therein such that for the combined emulsions a plot of total volume of grain against grain size exhibits at least two distinct peaks, one peak lying in the range 0.1 to 0.4 microns.

14. An element as claimed in claim 3, characterised in that the one or more silver halide layers have a distribution of grains therein such that for the combined emulsions a plot of total volume of grain against grain size exhibits at least two distinct peaks, one peak lying in the range 0.1 to 0.4 microns.

15. An element as claimed in claim 12, characterised in that the first and second silver halide emulsions are present in a single layer.

16. An element as claimed in claim 14, characterised in that the first and second silver halide emulsions are present in a single layer.

17. An element as claimed in claim 2, characterised in that the first silver halide emulsion is spectrally sensitised.

18. An element as claimed in claim 14, characterised in that the first silver halide emulsion is spectrally sensitised.

19. An element as claimed in claim 16, characterised in that the first silver halide emulsion is spectrally sensitised.

* * * * *